United States Patent [19]

Davidge et al.

[11] 3,989,372

[45] Nov. 2, 1976

[54] PHOTOCONDUCTOR CLEANING STATIONS

[75] Inventors: Ronald V. Davidge, Boulder County, Colo.; Dorris D. James, Lexington, Ky.; Frederick W. Johnson, Boulder, Colo.

[73] Assignee: International Business Machines Corporation, Armonk, N.Y.

[22] Filed: July 7, 1975

[21] Appl. No.: 593,917

[52] U.S. Cl. ..... 355/15; 15/256.52

[51] Int. Cl.[2] ..... G03G 21/00

[58] Field of Search ..... 355/15; 15/1.5, 256.5, 15/256.51, 256.52

[56] References Cited

UNITED STATES PATENTS

| | | | |
|---|---|---|---|
| 3,217,646 | 11/1965 | Sharkey | 355/15 X |
| 3,741,157 | 6/1973 | Krause | 355/15 X |
| 3,914,046 | 10/1975 | Tanaka et al. | 355/15 |

OTHER PUBLICATIONS

"Brush Cleaner With Electrostatic Precipitator" by D. C. Roller et al., IBM Tech. Bull., vol. 15, No. 12, May 1973, p. 3643.

*Primary Examiner*—R. L. Moses

*Attorney, Agent, or Firm*—H. F. Somermeyer

[57] ABSTRACT

A photoconductor member is cleaned by a rotating fiber brush. The cleaned particles are knocked from the brush by a knock-off bar causing substantial wear on the brush. To compensate for the wear, both the knock-off bar and the fiber brush are adjusted for maintaining cleansing contact between the photoconductor member and the brush, plus the brush with the knock-off bar. In a preferred form of the invention, the fiber brush also is an air impeller for entraining cleaned particles from the photoconductor drum into a disposal station which, by way of example, may contain a scavanging roll and an air filter. The adjustments are such that the air impeller properties of the rotating brush are maintained throughout the life of the brush.

48 Claims, 10 Drawing Figures

PHOTOCONDUCTOR CLEANING STATIONS

BACKGROUND OF THE INVENTION

The present invention relates to duplicating machines, particularly to portions thereof related to cleaning an image transfer drum and moving particulate material cleaned from the transfer drum into a cleaning station.

In duplicating machines, particularly those of the electrostatic copier type, image forming toner is removed from a rotatable photoconductor drum or a reciprocating photoconductor sheet after an image transfer. Various geometric arrangements have been proposed, and any geometric arrangement for separating the cleaning station from an image forming and transferring station of the machine can be practiced with the present invention.

Such cleaning stations have employed fiber brushes which are in cleansing contact with a photoconductor drum. The cleaning brush rotates synchronously with the photoconductor drum to clean the toner and other particulate matter from the drum in preparation for receiving a new image to be reproduced. The removed material is entrained in air and passes by an electrically charged scavanger roll. The charge of the entrained particulate matter is opposite to that of the roll; hence, the scavanger roll attracts a good share of such toner particulate matter. A doctor bar or other form of scraping bar removes the particulate matter from the scavanger roll from whence it is returned to a reservoir for reuse. Also, many of the electrostatic copiers include a filter for removing nontoner particulate matter from the copier. This not only keeps the photoconductor drum clean, but also prevents such particulate matter from contaminating the toner.

One of the problems in such cleaning apparatus is that the cleansing actions become less effective as the fiber brush wears. Such wear is believed caused by impact of the brush with a knock-off bar. The knock-off bar removes the toner and other particles from the brush, allowing them to be swept past the scavanger roll.

SUMMARY OF THE INVENTION

It is an object of the present invention to provide an improved cleaning station for a duplicating machine wherein the cleansing action of the station is automatically maintained throughout the life of the cleansing station.

It is a further object to provide a cleaning station wherein the cleansing brush also is an air impeller for removing particulate matter from the area being cleaned by entraining same in a flow of air past a scavanging portion of the station and wherein the air impeller action of the rotating brush is maintained throughout the life of the cleaning station.

In accordance with certain aspects of the invention, a surface cleaner for a photoconductor member having a surface to be cleaned includes a fiber cleaning brush adapted to induce triboelectric charges for removing particulate matter, particularly toner, from a photoconductor surface. A knock-off bar is disposed remotely from the photoconductor surface and impacts with the fiber brush for knocking the particulate matter from the brush, allowing same to be swept into the scavanging station. In a most preferred form of the invention, the knock-off bar and the fiber brush are simultaneously and synchronously adjustable with respect to the photoconductor surface for maintaining cleansing action with the photoconductor member while maintaining good toner knock-off characteristics between the brush and the knock-off bar.

Within the context of the invention, such adjustment is preferably automatic and can be either of the feed-forward or feedback type. In the feed-forward type of adjustment control, the number of machine cycles as represented reciprocations or rotations of the photoconductor drum are counted. Upon reaching a predetermined threshold, the knock-off bar and the fiber cleaning brush are automatically adjusted to an improved cleaning position. In a feedback type of adjustment control, particularly when the fiber cleansing brush acts as an air impeller, air pressure in the scavanging station is continuously monitored. Whenever the air pressure drops below a predetermined threshold, the knock-off bar and the fiber cleaning brush are adjusted to a more effective cleaning and air impelling position.

In a preferred form of the feed-forward embodiment of the invention, an all-mechanical apparatus is employed. A single motor drives a photoconductor drum and the fiber cleaning brush. A mechanical counter is actuated by rotations of the photoconductor drum, this being a measure of brush wear. After the counter has reached a predetermined count, the counter mechanically actuates a mechanical linkage which, in turn, adjusts the brush and the knock-off bar toward the photoconductor drum being cleaned.

Other types of feed-forward and feedback adjustment controls can be implemented with equal facility.

The foregoing and other objects, features, and advantages of the invention will be apparent from the following more particular description of a preferred embodiment of the invention, as illustrated in the accompanying drawing.

THE DRAWING

DETAILED DESCRIPTION

Figure 4:
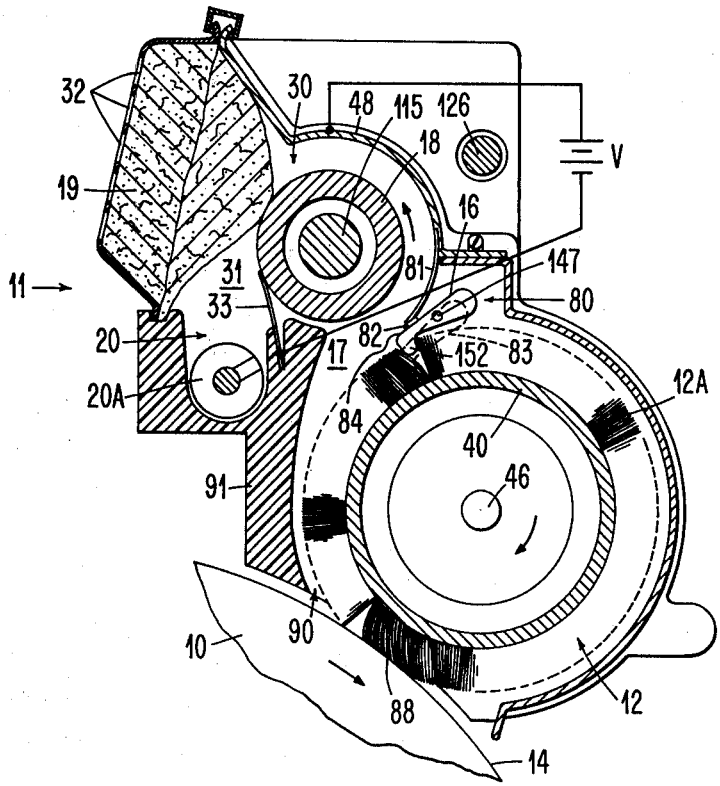
FIG. 4 is an enlarged diagrammatic sectional view taken in the direction of the arrows along line 4—4 of FIG. 1.

Referring now more particularly to the drawing, like numerals indicate like parts and structural features in the various views and diagrams. The invention is preferably practiced in a so-called "electrostatic" copier of duplicating machine such as that shown in U.S. pat. No. 3,758,774 in FIG. 1. The present invention concerns apparatus replacing the cleaning station 17 of the referenced patent. The cleaning station 11 of the present invention contemplates, in its preferred mode of operation, continuous contact between a photoconductor drum 10 and a cleaning brush 12. The drum and brush are synchronously, intermittently rotated, as will become apparent. In general, it includes a fiber cleaning brush 12 rotatable as indicated by the arrow and being in cleaning contact with a surface 14 of drum 10, which also simultaneously and synchronously rotates in the direction of the indicated arrow. Residual toner on surface 14 is removed by rotation of cleaning brush 12 with respect to drum 10 and entrained in air impelled by brush 12 rotation through entrance 17 (FIG. 4) to a scavanging chamber which includes scavanging roll 18. Filter 19 in the scavanging chambers filters particulate material not attracted to the electrically charged roll 18. Below the scavanging chambers is a toner recovery area 20 which returns scavanged toner to a toner reservoir in the copier for reuse. As best seen in FIG. 4, a negative high voltage supply "V" has its anode grounded to housing 48 and its cathode connected to doctor bar or scraper bar 33. When a new brush 12 is installed, toner particles may tend to accumulate in the brush such that fewer toner particles enter the chambers 30 and 31. With usage, this effect diminishes.

In a constructed embodiment of cleaning station 11, rotatable cleaning brush 12 and knock-off bar 16 (FIGS. 3 and 4) were adjustably mounted by first and second brush mounting plates 23 and 24. Plates 23 and 24 are, in turn, adjustably mounted on machine frame 25 and, in particular, on upstanding end blocks 26 and 27 secured to and forming a part of the machine frame 25. To remove particles from brush 12, the arrangement is such that rotation of cleaning brush 12 impacts the fibers against toner knock-off bar 16. In accordance with the invention, wear of the brush fibers by such impact is compensated for to maintain a good cleansing contact by brush 12 with surface 14 while simultaneously maintaining air impelling action of brush 12.

The toner particles and other particulate matter which may contaminate the machine are entrained in an air stream to enter a scavanging chamber at 17. Negatively electrically charged scavanging roll 18 attracts the oppositely charged toner particles. Other particles either are maintained entrained in the air and trapped by filter 19 at upper air chamber 30 or carried to scavanger roll 18. Filter 19 is in rubbing contact with the surface of scavanger roll 18 such that it effectively divides the scavanging chamber into two separate air chambers 30 and 31. Lower air chamber 31 has a lower air pressure than upper chamber 30. The main exit for air impelled into the scavanging chamber is through filter 19 and then to atmosphere via large rectangularly elongated exit ports 32. The rubbing contact between filter 19 and the surface of scavanging roll 18 is such that toner particles electrically adhering to the surface of roll 18 are not removed by such contact. Other particulate matter which does not have the opposite charge of the toner particles has less electrical-caused adherence and tends to be removed by such rubbing contact. The toner particles remaining on scavanging roll 18 are scraped from the surface by the scraping contact of electrically conductive doctor bar 33. Such toner particles drop into toner recovery area 20 from whence they travel through an auger 20A to a toner reservoir (not shown) for reuse in the copying machine. The photoconductor drum 10, fiber cleaning brush 12, and scavanging roll 18 all are driven by a single motor 34 (FIG. 6) via a later-described drive system. Each time a copy is to be made, actuation of the copier machine by a pushbutton (not shown) activates single motor 34 to simultaneously rotate drum 10, brush 12, and roll 18. As will become more apparent, all other portions of the cleaning station are also actuated by single motor 34.

To achieve the air impelling action and resultant cleaning action of scavanging apparatus 11, brush 12 rotates at a high rotational velocity, such as 1800 rpm, to have a high peripheral speed. The impacting of the fibers on knockoff bar 16 may result in a significant reduction in the effective diameter of the brush; total brush diameter reduction is believed caused by a combination of fiber wear and the knock-off bar compaction of the fibers. Experimentation has shown that the cleaning engagement of brush 12 with photoconductor surface 14 and knockoff bar 16 is critical to achieve not only cleaning action, but also the desired air impelling action, particularly if brush 12 is the only air pump in cleaning station 11. Reduction of air impelling action results in the toner and other particulate matter entering other portions of the machine, such as shown in the referenced patent, possibly causing malfunctions. If the cleaning contact on photoconductor surface 14 is too light, then the photoconductor surface is not cleaned. On the other hand, overengagement of brush 12 with photoconductor surface 14 results in too much air pressure being built up such that the particulate matter, including toner, is forced out of the cleaning station into other portions of the machine. Further, engagement of knock-off bar 16 with brush 12 is also critical in that an overengagement compacts the fibers which, in turn, reduces the cleaning contact with photoconductor surface 14. Overengagement also appears to increase the brush wear and compaction rate. Also, overengagement by brush 12 with either knock-off bar 16 or photoconductor surface 14 may result in other machine malfunctions.

Accordingly, the method of the present invention provides adjustment of the brush 12, knock-off bar 16, and photoconductor surface 14 such that the operative engagement therebetween remains essentially constant, even though the effective diameter of brush 12 decreases. These results are achieved by simultaneously adjusting the position of brush 12 and knock-off bar 16, as will be later more fully described. A preferred constructed embodiment has a major portion of the cleaning station adjusted toward photoconductor surface 14, while knock-off bar 16, inside the cleaning station, is simultaneously and equally adjusted radially inwardly to brush 12.

Figure 2:
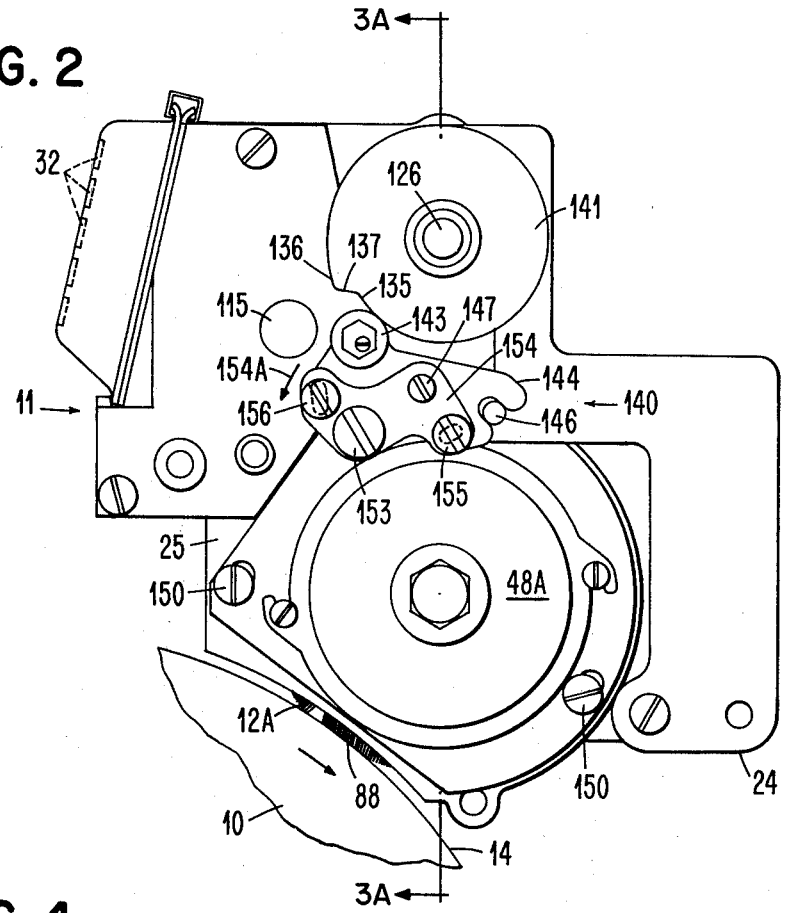
FIG. 2 is an enlarged partial and view taken in the direction of the arrow 2—2 of FIG. 1.
Figure 3:
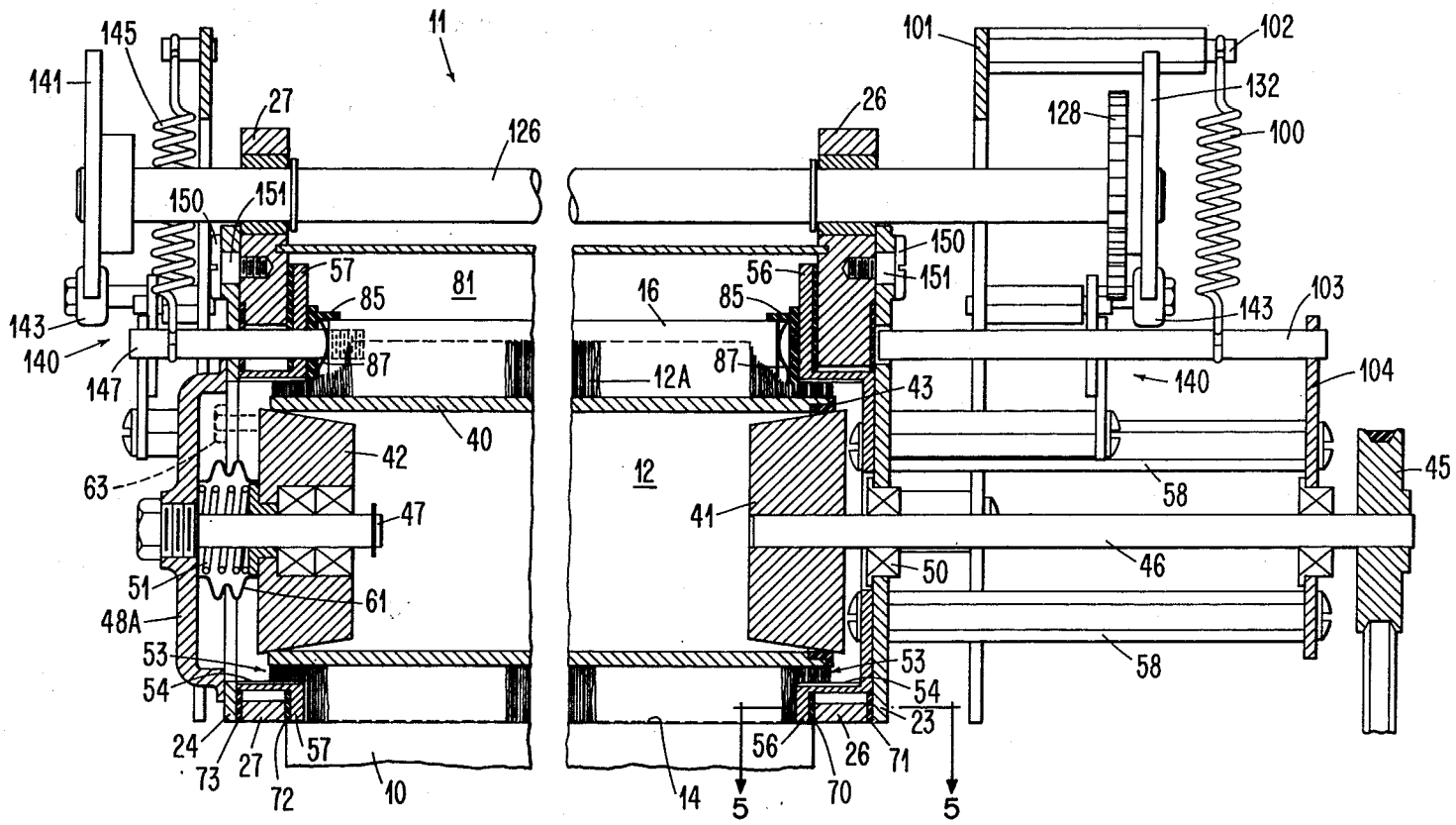
FIG. 3 is an enlarged, abbreviated, sectional view taken in the direction of the arrows along line 3—3 of FIG. 1 and more specifically in the direction of the arrows in the two planes indicated by the line 3A—3A of FIG. 2.

Referring now more particularly to FIGS. 2–4, the constructional features of cleaning station 11 for effecting simultaneous cleaning and air impelling action by brush 12 are described in detail. Brush 12 consists of a carpet-like material 12A adhesively secured to the annular periphery of hollow circular support cylinder 40. A pair of facing support cones 41 and 42 support cylinder 40 at opposite axial ends. Elastomeric drive bushing 43 adhesively secured to cylinder 40 securely and frictionally engages drive support cone 41. Motor 34 rotates brush 12 via driven pulley 45 and drive shaft 46 which rotationally supports driving support cone 41. Shaft 46 is suitably journaled in first brush mounting plate 23. The opposite axial end of brush 12 is supported through idler support cone 42 journaled for rotation on stationary shaft 47.

Cylinder 40 is secured to cones 41 and 42 by an interference fit. Drive cone 41 is axially held in a reference or fixed position by bearings 50 in first brush mounting plate 23. Helical coil spring 51 bears against cleaner station housing 48 end cap 48A to urge idler cone 42 axially toward drive cone 41 resulting in a secure interference fit support for cylinder 40. Alternatively, cylinder 40 can be adhesively secured to suitable circular cylindrical support blocks, such as cones 41 and 42.

Figure 5:
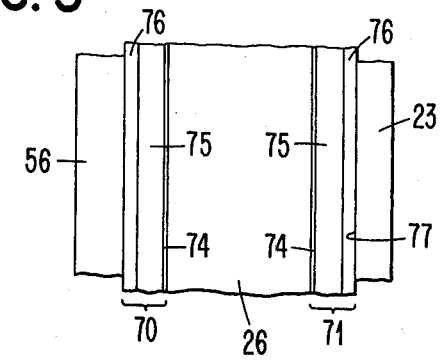
FIG. 5 is an enlarged partial sectional view showing a second portion of axial end air seals for an adjustable cleaning brush assembly using the present invention and taken in the direction of the arrows along line 5—5 of FIG. 3.

Since brush 12 impels air, suitable seals are provided at both axial ends of housing 48 and adjacent entrance 17 to scavanging chambers 30 and 31. The air sealing at each axial end of brush 12 has two portions, first portion being on the annular periphery of the axial end portions of brush 12 and characterized by shortened fibers 53 which bear against polyethylene terephthalate sealing anti-wear collars 54; plus a second portion consisting of axially laminated seals, later described (FIG. 5).

The first portion of the axial seals includes anit-wear collars 54 (FIG. 3) supported, respectively, on first and second brush mounting plates 23 and 24 such that the seals have a constant relationship to brush 12 irrespective of the later-described adjustments. One collar 54 is suitably adhesively secured on the inner cylindrical wall of seal inner support block 56. Support block 56, in turn, is secured at three places to the threaded ends of stand-offs 58 which extend through first brush mounting plate 23, thereby securing inner support block 56 to plate 23 for movement therewith. At the opposite axial end of brush 12, a second seal support block 57 and brush mounting plate 24 are secured together by machine screws 63. End blocks 26 and 27 are slotted (not shown) to allow machine screws 63 and 85 to freely move with the brush 12 adjustments.

The axial end seals include shaped and laminated apertured seals 70 and 71 secured to end block 26 and similar seals 72 and 73 secured to end block 27. As best seen in FIG. 5, each seal has three layers—an adhesive layer 74 facing the respective end blocks, an intermediate layer consisting of polyurethane foam 75, and a laminate polyethylene terephthalate outer antifriction layer 76. All seals 70 through 73 are configured to match the cross-section of end blocks 26 and 27, respectively. The outer laminate polyethylene terephthalate layers 76 respectively slide against the facing surfaces 77 and 78 of seal support blocks 56 and 57. Seals 71 and 73 have their respective layers 76 in sliding contact, respectively, with plates 23 and 24, the seals being adhesively secured respectively to end blocks 26 and 27.

In summary, the first portion of the axial seal includes a pair of anti-friction collars 54 extending coaxially over the opposite axial end portions of brush 12 to limit air flow axially outwardly toward the respective opposite axial ends. Additionally, four laminated seals 70, 71, 72, and 73 secured respectively to end blocks 26 and 27 complete the axial end seals in the second portion. Such seals are in sealing engagement with the above-mentioned brush support members which move with respect to the seals as brush wear is compensated.

A third portion for sealing cleaning station 11 is about knock-off bar 16. As best seen in FIGS. 3 and 4, knock-off bar 16 axially extends between the inner axial ends of collars 54 such that shortened fibers 53 do not impact knock-off bar 16, hence, do not wear. Such an arrangement permits the seal to be moved with the brush adjustment thereby simplifying construction of the adjustable cleaning station.

Referring now more particularly to FIG. 4, it is seen that air pressure generated by brush 12 rotation moves particles through entrance 17 of the scavanging chamber immediately adjacent knock-off bar 16. On the downstream side of knock-off bar 16, as at 80, there is relatively low air pressure. Hence, unless areas 17 and 80 are sealed, air tends to flow to 80 rather than to upper air chamber 30, as is desired for scavanging action. Such sealing is provided by a shaped polyethylene terephthalate sealing flap 81 extending parallel to knock-off bar 16. The resiliency of flap 81 forces the axially extending polyurethane foam sealing pad 82 against knock-off bar 16. As knock-off bar 16 adjusts from the initial position as shown in solid line to an ultimate position as shown in dotted line 83, flap 81 resiliency continues to urge sealing pad 82 against the upper surface 84 of knock-off bar 16 maintaining air seal throughout the range of adjustments in cleaning station 11.

Additionally, the axial extremities of knock-off bar 16 are also sealed throughout the adjustment range of station 11. To this end, a pair of shallow plastic anti-friction cup-shaped seals 85 are disposed over the respective ends of knock-off bar 16. A pair of leaf springs 87, respectively disposed between the ends of knock-off bar 16 and the webs of caps 85, resiliently urge the caps against the respective surfaces of seal support blocks 56 and 57. Cups 85 move with bar 16 with the axial end portions continuously bearing against blocks 56 and 57 to maintain the seal irrespective of bar 16 adjusted positions.

In summary, sealing flap 81 and pad 82 provide the air seal between volumes 17 and 80 along the length of knock-off bar 16, whereas the pair of cups 85 complete the sealing action at the axial ends. Note that flap 81 also bears against both cups 85.

From all of the above, it can be seen that the cleaning contact of brush 12 with surface 14, as at 88, through cleaning inlet port 90 extending between brush 12 and insulating bar 91 through entrance 17 to scavanging chamber 30 is maintainable at a relatively high pressure for facilitating air flow outwardly through filter 19 past scavanging roll 18. Such sealing maintains the air impelling action of brush 12 and also prevents contamination of the remainder of the copying machine caused by the entrainment of toner particles in the air moving from cleaning contact area 88 through filter 19.

Next, the adjustable support and cam driven adjustment is described. Following that, several criteria and apparatus for measuring the criteria for actuating the adjustment will be described. The above-described cleaning station 11 assemblage is movably mounted on frame 25, specifically end blocks 26 and 27. Such assemblage is moved between an initial position of maximum spacing between cylinder 40, the surface to be cleaned 14, and an ultimate adjustment position wherein the spacing between cylinder 40 and surface 14 is reduced. The entire cleaning station 11 is yieldably urged by springs 100 and 145 (FIG. 3) toward the initial position. Frame 25 includes upstanding plate 101 having horizontally extending stud 102 supporting one end of compression spring 100. The other end of spring 100 yieldably urges horizontal shaft 103 upwardly to yieldably urge station 11 away from surface 14. Horizontal shaft 103 is secured to brush mounting plates 23 and 24 and to outrigger header plate 104. A plurality of standoffs 58 extending between header 104 and brush mounting plate 23 provide sufficient rigidity to the assembly such that springs 100 and 145 urging pulls the entire cleaning station assemblage as a unit. Drive shaft 46 for brush 12 is journaled both in brush mounting plate 23 and header 104.

Figure 7:
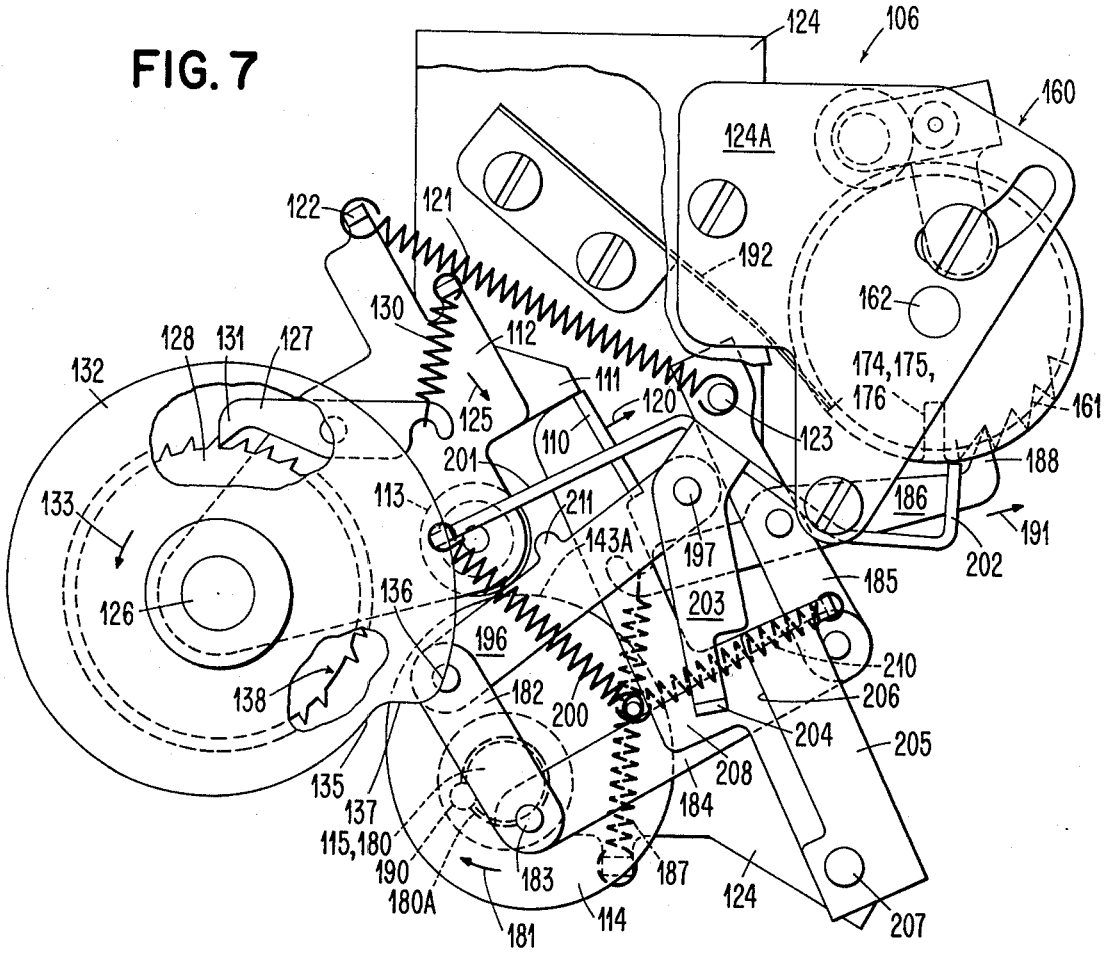
FIG. 7 is an enlarged end view taken in the direction of the arrow 7—7 of FIG. 1 for showing an adjustment actuator.

Each incremental adjustment from the initial position to the ultimate position is powered by motor 34 via the now-described driving mechanisms which are actuated by an adjustment release mechanism (FIG. 7—to be described). All incremental adjustments are based upon later-described machine status criteria calling for improved air impelling and cleaning action. The criteria responsive actuator 106 (either completely mechanical or electromechanical) actuates the following described escapement mechanism which forces the incremental adjustment of brush 12. Actuator 106 has cam follower stop 110 (FIGS. 1 and 7) bearing against end portion 111 of escapement actuating cam follower 112. This stopping action keeps cam follower roller 113 (FIG. 1) away from adjustment driving cam 114 secured at one end of shaft 115 mounting scavanging roller 18. Shaft 115 is intermittently rotated by motor 34 synchronously with drum 10 and brush 12, as will be later described. Driving cam 114 synchronously rotates with all three members such that the incremental adjustment of brush 12 and knock-off bar 16 is synchronous with those operations, particularly drum 10 rotation.

The escapement mechanism for engaging roller 113 to driving cam 114 is actuated by stop 110 moving in the direction of arrow 120 (FIG. 7) thereby releasing cam follower 112 to move under the yieldable urging of spring 121. Spring 121 extends between finger 122 on cam follower 112 and horizontal spring stud 123 secured to the frame 25 (via plate 101) supported plate 124. Cam follower 112 then pivots in the direction of arrow 125 about shaft 125 such that roller 113 goes into a cam-following contact with adjustment driving cam 114. Such pivoting pulls escapement lever 127 over one tooth of ratchet wheel 128. Compression spring 130 pivots lever 127 such that pawl end 131 engages a tooth on ratchet wheel 128 in preparation for incrementing it and adjustment cams 132 and 141 for incrementing brush 12 one step toward surface 14. Axially spaced cams 132 and 141 may be replaced by a single cam (not shown) at or near the axial center of cleaning station 11. Cam 132 and ratchet 128 are preferably constructed as a unitary member.

The actual adjusting drive is provided by adjustment driving cam 114 high-rise portion 143A (FIG. 7) forcing cam follower 112 to pivot in a sense opposite to arrow 125. Pawl end 131 engaging a ratchet tooth forces ratchet 128 to rotate one incremental step in the direction of the arrow 133. At maximum pivot travel of follower 112, stop 110 returns to its stop position such that as driving cam 114 continues its rotation, follower 112 again pivots in the direction of arrow 125 under spring 121 urging to stop 110. Here, follower 112 rests until actuator 106 again releases the escapement mechanism for the above-described adjustment driving action.

Adjustment cams 132 and 141 each have an aligned initial position radius at 135 which is a minimum radius for allowing cleaning station springs 100 and 145 to yieldably urge the cleaning station to the initial position. The cam contour from the initial position 135 extending in a direction opposite to arrow 133 follows a linear Archimedes-type spiral to final position 136, which is a maximum radius. Continued movement of cam 132 would return (reset) the station to the initial position 135 via steep ramp portion 137 of the cams 132 and 141. To prevent such action in an automatic sense, one ratchet tooth position at 138 allows the escapement mechanism, including cam follower 112, to repeatedly move pawl end 131 across the omitted tooth area 138 such that cam 132 is not moved beyond position 136. Accordingly, after brush 112 and knock-off bar 16 have been automatically incrementally adjusted to their ultimate position, represented by cam radius 136, the brush and knock-off bar continue to operate until manual intervention. As such, brush 112 can be used until the cleaning and air impelling action deteriorates to an unacceptable level. At this time, the cleaning station 11 is disassembled for installing a new brush. At this time, shaft 126 is rotated in the direction of arrow 133 returning the cleaning station to the initial position represented by position 135. Springs 100 and 145 return the cleaning station to the initial position whereat the above-described adjustment cycles repeat.

Incremental rotation of adjustment cams 132 and 141 cammingly drives linkage mechanism 140 to correspondingly incrementally move brush mounting plates 23 and 24 toward the ultimate position, as well as adjusting knock-off bar 16 toward its ultimate position 83 (FIG. 4). Because of the axial length of cleaning station 11, adjustment mechanism 140 has a first and second portion 140F and 140R for, respectively, adjusting opposite axial ends of brush 12 and knock-off bar 16. To this end, auxiliary adjustment cam 141 is secured to shaft 126 opposite to adjustment cam 132. Cam 141 is precisely aligned with and has the same contour is adjustment cam 132. Since both mechanisms are substantially identical, the component parts are identified by the same numerals, one description describing both adjustment mechanisms for plates 23 and 24. To prevent binding, knock-off bar 16 (see FIGS. 1 and 2) has a three-point support. Adjustment cams 132 and 141 bear against cam following roller 143 eccentrically rotatably mounted on crank 144. Spring 145 urges crank 144 about machine frame supported pivot stud 146 such that crank 144 pivots under spring 145 urging to engage roller 143 in cam following relationship to cams 132 and 141, respectively. Crank 144 is secured to the respective brush mounting plate 23, 24 via pivot stud 147. As crank 144 pivots about pivot stud 146, the rotation is translated to brush mounting plate 23, 24 through the stud 147 such that plates 23 and 24 slide radially toward drum 10 on shoulder screws 150 (FIGS. 1, 2, and 3), which are secured respectively in frame support end blocks 26 and 27. The brush mounting plates slide between an anti-friction washer 151 and each of the heads of the shoulder screws 150.

Crank 144 also supports one axial end of knock-off bar 16 axially aligned shaft 147 which constitutes a pivot axis for knock-off bar 16 and, of course, move with cleaning brush 12 during each adjustment step. Additionally, knock-off bar 16 pivots radially inwardly toward its ultimate position 83 (FIG. 4) by the rotational action of crank 144. The pivoting of brush engaging end portion 152 is supported at both axial ends by screws 153 (FIG. 2), respectively supported by crank 144. From FIG. 2 it can be seen that as cam 141 rotates crank 144 about pivot pin 146, the relationship between shaft 147 and screws 153 also has a rotational translation; that is, screws 153 move in the direction of the arrow 154A through a greater distance than shaft 147. It should be remembered that both shaft 147 and screws 153 are simultaneously translated toward drum 10 with brush mounting plates 23 and 24. Brush engaging portion 152 is aligned axially with screws 153.

Since it is important that the radial relationship between portion 152 of knock-off bar 16 be equal throughout the axial length of brush 12, an adjustment is provided for ensuring such constant engagement. Plates 154 (FIGS. 2 and 3) have two elongated slots adjustably receiving a pair of bolts 155 and 156 such that each plate 154 is adjustable with respect to crank 144. For this adjustment mode, screws 153 secured to plates 154 are adjustably mounted on cranks 144. Without the adjustment feature, the screws 153 would be mounted directly on the two cranks 144. During installation of brush 12 and knock-off bar 16, the two adjustment plates are moved until an appropriate toner knock-off relationship is established between bar 16 and the fibers of brush 12.

Figure 1:
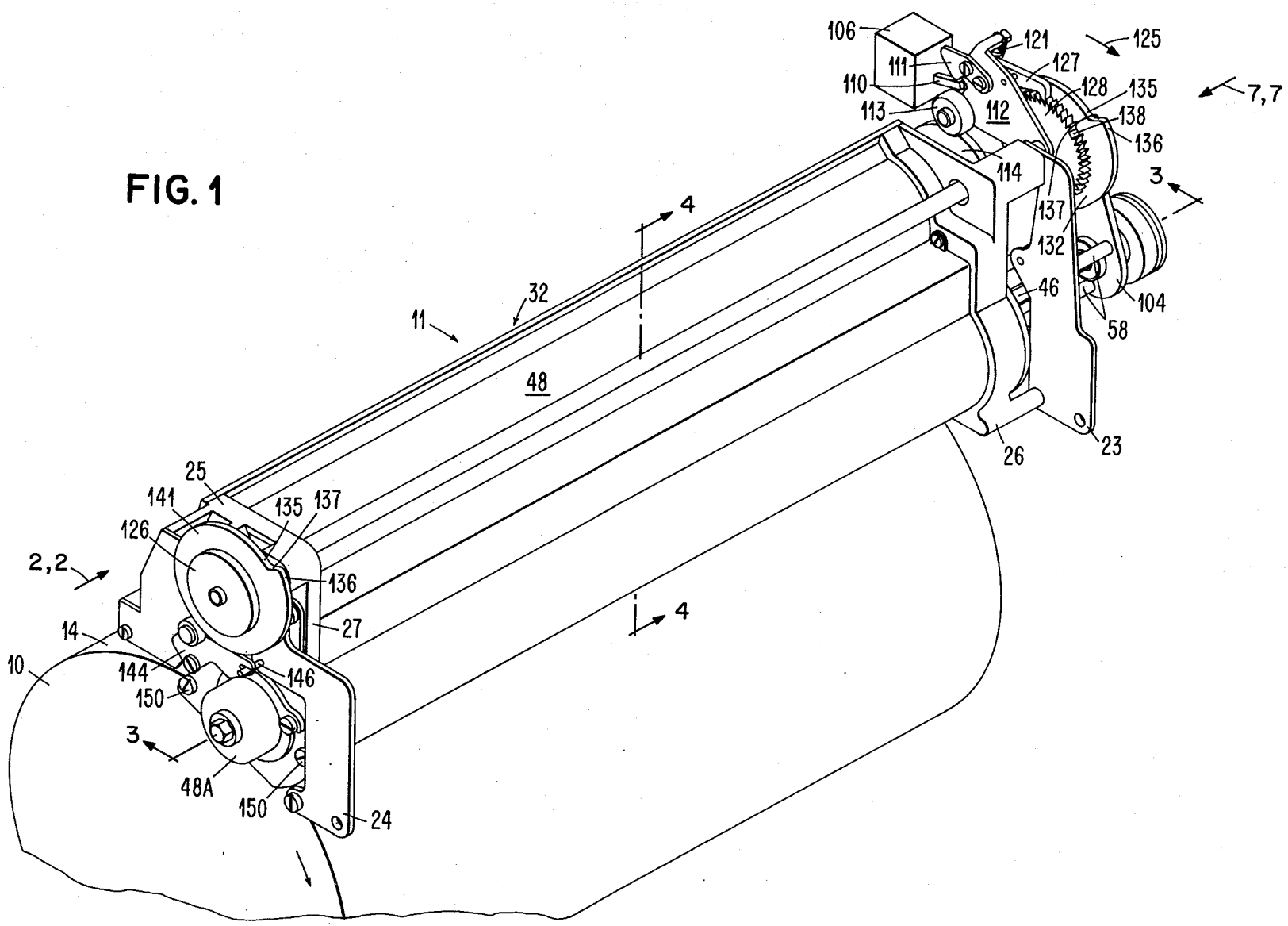
FIG. 1 is a simplified diagrammatic perspective view of an apparatus incorporating the present invention.

The preferred and completely mechanically actuated criterion responsive actuator will next be described in detail with general reference to FIGS. 1, 2, and 3, and particular reference to FIGS. 7 and 8. Alternative actuators will also be later described. In the preferred constructed embodiment, the number of rotations of photoconductor carrying drum 10 are counted. When the number of rotations equals a predetermined count, stop 110 is actuated to release the above-described escapement mechanism for permitting adjustment driving cam 114 to provide one incremental adjustment. This is a so-called "feed forward" type of automatic adjustment wherein the rate of brush wear, as caused by the impacting of the fibers against knock-off bar 16, as well as the cleaning contact with photoconductor surface 14, is precalculated. In a presently constructed embodiment, it was determined that the wear of the fibers of brush 12 is substantially linear over the life of the brush with the wear rate being sufficiently predictable to permit such feed forward automatic adjustment. This linear wear rate is represented by the linear Archimedes spiral contour of adjustment cams 132 and 141.

Mechanical counter 160 (FIGS. 7 and 8) is suitably coupled, as later described, to photoconductor drum 10 such that a predetermined number of rotations of drum 10 through an escapement mechanism (later described) drivingly engages input ratchet wheel 161 to step one ratchet tooth position for said predetermined number of rotations. Ratchet wheel 161 is suitably mounted for rotation on shaft 162 journaled into plate 124A, which is supported by frame 25. Input ratchet wheel 161 is secured to first stage or input wheel 163. A count transfer tooth 164 gearingly engages mutilated transfer pinion 165 for turning same approximately 90°. Rotation of pinion 165 about its shaft 166 moves second stage input ratchet wheel 167 of second stage wheel 168 which is incremented each time pinion 165 rotates 90°. Note that first stage wheel 163 has its transfer teeth only in one location. Accordingly, pinion 165 is rotated a quarter rotation for each complete rotation of wheel 163. In a similar manner, the count of the second digit position represented by rotation of wheel 168 is transferred through a second multilated pinion 170 to a third input ratchet wheel 171 which, in turn, is affixed to a third stage wheel 172. Transfer of counts between the first, second, and third counter wheels is as described for pinion 165. Interposed between third ratchet wheel 171 and second pinion 170 is a rotational direction reversing idler gear 173.

Since it is desired only to determine when counter 160 has reached one count, only one readout mechanism is required. Each of the counter wheels 163, 168, and 172 have full-count indicating slots 174, 175, and 176, respectively. When such slots are in a predetermined position, such as the illustrated position for slots 174 and 175, the corresponding count wheels have completed one rotation. Accordingly, when all three slots are axially aligned, the counter has traversed through one complete count sequence indicating that drum 10 has gone through a predetermined number of rotations such that brush 12 and knock-off bar 16 should now be incrementally adjusted. The total count is determined by gearing in the counter.

Referring now more particularly to FIG. 7, actuation of input ratchet wheel 161 is described. Input to the counter mechanism is via input driving shaft 180, an extention of shaft 115, described later with respect to FIG. 6, which rotates in the direction of arrow 181. Pin 183 eccentrically fixed to shaft 180 drives crank 182 to rotate in a circle indicated by dashed line 180A. Crank 182 drives escapement release link 184. Link 184, in turn, pivots escapement releasing crank 185 about pivot pin 123 moving escapement lever 186 over one ratchet tooth of input ratchet wheel 161. Escapement actuating spring 187 keeps pawl end 188 of lever 186 bearing against ratchet wheel 161.

As shaft 180 continues to rotate, pawl end 188 slides over one ratchet tooth. At the extreme rotational position of crank pin 183, as at 190, pawl end 188 has moved to an actuating position adjacent one ratchet tooth. As shaft 180 continues to rotate crank pin 183, linkage 184 and 185 moves escapement lever 186 in the direction of the arrow 191 to increment ratchet wheel 161 one tooth position, i.e., increments counter 160 by unity. Back rotation of input wheel 161 is prevented by leaf spring stop 192. To sense that counter 160 has reached its full count, crank 182 actuates crank 196 to pivot about fixed pivot stud 197. Such pivoting, as will become apparent, allows extension spring 200 to yieldably urge the count sensing bar 201 to pivot about stud 197 for urging the three-fingered end portion 202 against counter wheels 163, 168, and 172 (FIG. 8). If the sensing slots 174, 175, and 176 (FIG. 8) are aligned, the three fingers (not shown) in end portion 202 enter the slots; otherwise, one of the fingers bears against one of the three wheels 163, 168, and 172 (FIG. 8) preventing further pivoting of sense bar 201. Assume that counter 160 is at its full count and that the three fingers of end portion 202, respectively, enter the three slots 174, 175, and 176. Sensing bar 201 is supported by counter-output actuating link 203 which is also pivoted on stud 197 and has actuating end portion 204 for engaging stop release link 205 as at 206. The stop release link 205 pivots about fixed pivot stud 207 (secured to plate 124) under the urging of link 203. Stop release link 205 includes elongated arm portion 208 with cam follower stop 110 at its free end. Pivoting elongated arm portion 208 and release link 205 moves cam follower 110 in the direction of arrow 120 to actuate an incremental adjustment of brush 12 via the escapement mechanism including escapement lever 127, as previously described. From the above, it can be seen that actuation of counter 160 and the actuation of the escapement mechanism, including escapement lever 127, is synchronous to the operation of drum 10, as will be more fully described later with respect to FIG. 6.

Cam follower stop 110 is returned to its stop position by spring 210, which also rotates sense bar 201 outwardly of the counter output slots 174, 175, and 176. Crank 196 has upstanding finger 211 which engages sense bar 201 adjacent its attachment to return spring 200. Accordingly, as shaft 180 continues to rotate crank 182 past input position 190, finger 211 engages sense bar 201 removing it from the sensing slots 174, 175, and 176 in preparation for actuating counter 160 to unity count position. This shaft 180 rotation also moves actuating end 204 away from output actuating link 205 allowing spring 210 to return cam follower stop 110 to its illustrated position prior to the time that the escapement mechanism, including escapement lever 127, is released by adjustment driving cam 114. In this regard, it should be noted that the shape of cam 114, the operation of escapement mechanism including lever 127, and the counter input and output mechanisms must be so designed that operation is sequential and not overlapping. Examination of the figures will show that the design illustrated therein provides such desired sequential, but synchronous, operation.

Figure 6:
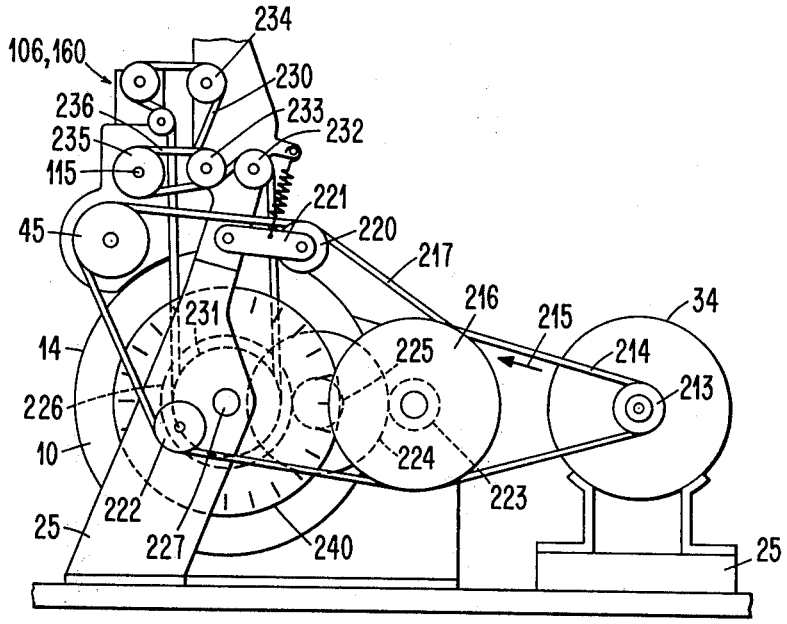
FIG. 6 is a diagrammatic showing of the single motor drive for the FIG. 1 illustrated apparatus.

The single motor drive connections advantageously used in practicing the present invention are best understood by referring to FIG. 6. Motor 34 is suitably mounted on machine frame 25. Motor output pulley 213 drives first belt 214 in the direction of arrow 215. Main power transfer pulley 216 driven by belt 214, in turn, drives power distribution belt 217. Idler pulley 220, on spring-loaded idler arm 221, keeps belt 217 at a suitable tension. Belt 217 directly drives brush 12 via brush drive pulley 45, thence, over idler pulley 222. A set of gears 223, 224, 225, and 226 drivingly engage main drive pulley 216 with photoconductor carrying drum 10. Gear 223 is on pulley 216, while gear 226 rotates shaft 227 of drum 10.

Scavanger roll 18 is driven via intermediate drive belt 230 which extends from a driving pulley 231 on shaft 227 and extends over idler pulley 232, pulley 233, idler pulley 234, and finally back to driving pulley 231. The scavanger roll mounted on shaft 115 is driven via pulley 235 secured on one end of shaft 115 and belt 236 extending from pulley 235 to a second belt groove on pulley 233. Counter 160 is driven via shaft 180 (FIG. 7), an extension of shaft 115.

Figure 8:
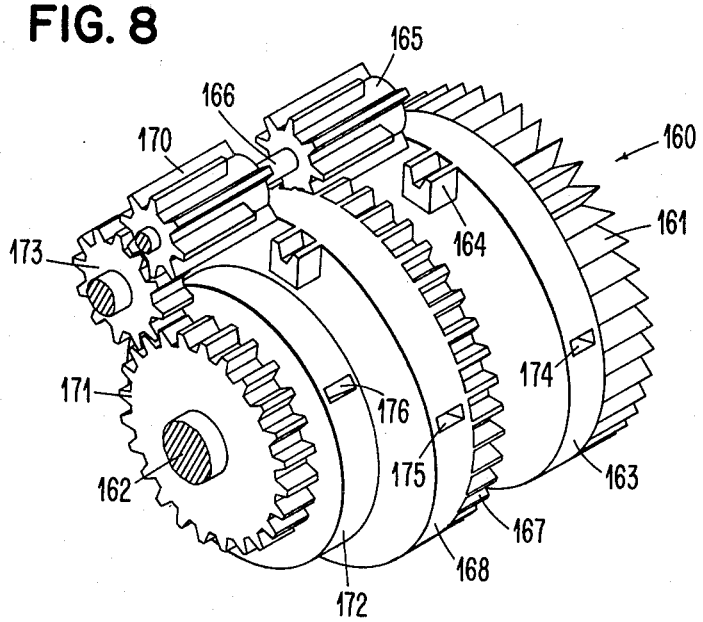
FIG. 8 is a diagrammatic perspective of a mechanical counter usable with the FIG. 7 illustrated actuator.

While it is preferred that the completely mechanical counter and brush adjustment actuator illustrated in FIGS. 6, 7, and 8 be used with the present invention, two alternative adjustment actuators are described for illustrating the versatility of the invention in these regards. Since rotation of photoconductor drum 10, brush 12, and scavanger roll 18 is synchronously intermittently actuated, the number of rotations of any one of these three rotatable members provides an indication of brush wear and, hence, the need for adjustment. The number of motor 34 actuations may also be used to indicate brush wear; a combination of motor actuations and member rotations is also suitable.

Since all operations of a typical electrostatic copier are synchronized to the photoconductor drum 10 rotation, it is economically desirable to select that member as a criterion for brush wear. In this regard, a tachometer disk 240 secured on shaft 227 rotates with drum 10. A tachometer sensing unit 241 (FIG. 9) of usual construction senses rotational position of drum 10. Accordingly, tachometer disk 240 preferably has one or more fiducial marks 240A for indicating rotational position of drum 10. Sensor 241 supplies position indicating signals over cable 242 to an electronic decoder 243. Decoder 243 supplies position indicating control signals over cable 244 for operating other portions of the copier (not shown) such as paper feed, lamp switching, coronas, etc. (none of which are shown). One fiducial mark on tachometer disk 240, as at 245, actuates relay driver 246 to increment electromechanical counter 247 by unity for each drum 10 rotation. Electromechanical counter 247 replaces mechanical counter 160 of FIG. 8. Counter 247 of usual construction has an overflow output set of contacts 250 signifying that the count modulus has been traversed by counter 247. Closure of contacts 250 indicates that drum 10 has completed a sufficient number of rotations such that brush 12 should be adjusted, as above described. Closure of contacts 250 supplies logic circuit actuating signal (ground reference potential, for example) to logic AND circuits 251 and 252. AND 251 synchronously actuates relay pulser 253 a command signal received over line 254 from decoder 243. This timing pulse is generated by a special mark 255 on tachometer disk 240. Relay pulser 253 then synchronously actuates solenoid 256 to pull stop detent 257 for releasing relay follower 112, as previously described. Spring 258A returns stop 257 to a latching position upon release of the current from solenoid 256. Detent 257 of FIG. 9 replaces stop 110 of FIG. 7. AND 252 responds to the counter 247 output signal, plus an additional timing signal from decoder 243 to actuate relay driver 258 to clear counter 247. In the alternative, counter 247 may be permitted to cycle through without the clearing function.

Adjustment driving cam 114, mounted on shaft 115 of scavanger roll 18, is synchronized to drum 10 rotation via the FIG. 6 synchronous driving system. Upon setting up the machine for practicing the present invention, care should be exercised in ensuring that cam 114 and all of the other synchronously operated parts are appropriately adjusted.

The previously described adjustment actuators are of the feed-forward type; i.e., the wear of brush 12 is assumed to follow a precalculated wear pattern. For many types of brushes, this may be true. In such actuators, the adjustment cam 132, 141 contours adjust in accordance with predicted wear. Feedback of brush adjustment status to the actuators is also contemplated within the scope of the present invention. Such feedback-driven actuators measure operating conditions within the copier adjacent the brush for determining the effectiveness of the brush either as an air impeller, a cleansing agent, or both.

Figure 9:
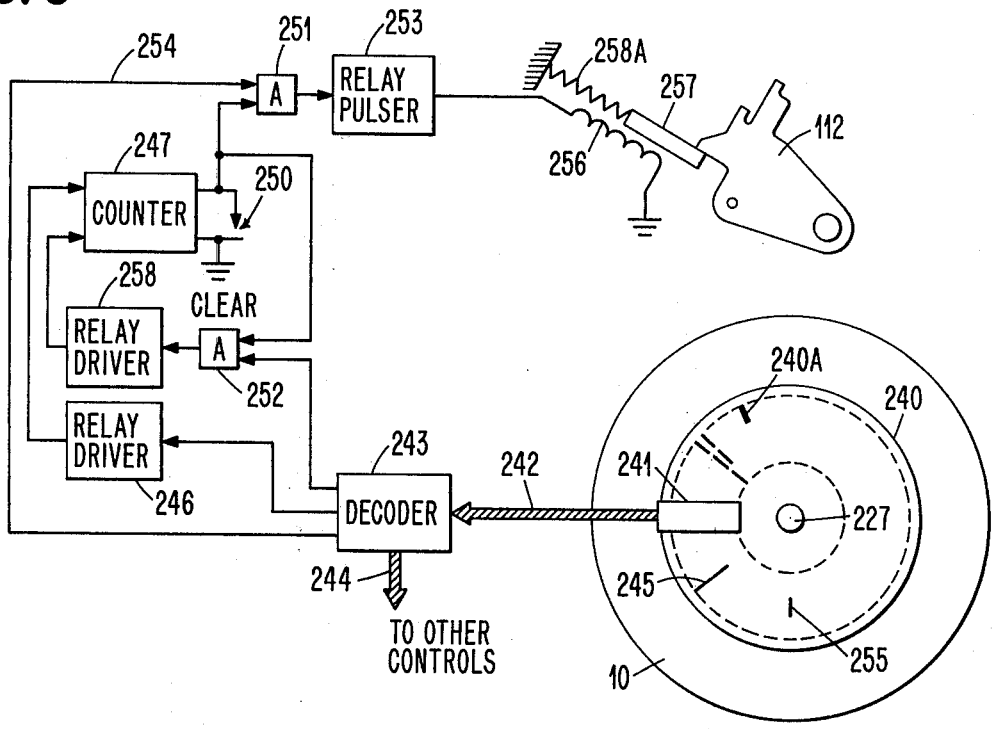
FIG. 9 is a diagrammatic showing of an electromagnetic adjustment actuator.
Figure 10:
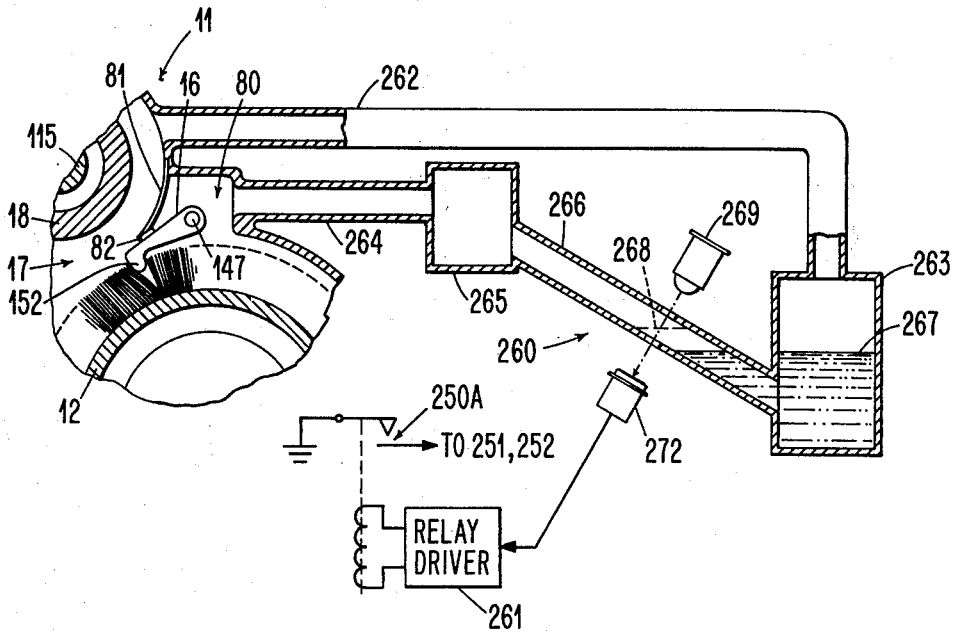
FIG. 10 is a diagrammatic showing of an air pressure responsive adjustment apparatus.

Referring now to FIG. 10, a simple apparatus is shown for measuring whether or not the wear and compaction of the brush 12 fibers has reduced the effective operation of the brush. Brush 12 provides impelled air into the air volume at entrance 17 of the scavanging apparatus. Such area has a higher air pressure than either ambient or low pressure or downstream volume 80. Remembering that knock-off bar 16 is air sealed such that air does not flow from entrance 17 to volume 80, the maximum differential air pressure is provided between these two volumes. This pressure differential is measured by differential pressure measuring apparatus 260 to actuate a relay 261 (replace contact 250 of FIG. 9) to move stop bar 257 (FIG. 9) in the same manner that electromechanical counter 247 actuated solenoid 256. High air pressure from throat or input 17 is transmitted through air tube 262 to sealed chamber 263 whereat it is compared with the low pressure side 80 through tube 264 and baffle chamber 265. The fluid monometer includes inclined tube 266 having its lower end in fluid communication with reservoir chamber 263. The fluid 267 is opaque. If the differential pressure between volumes 17 and 80 is sufficiently high, fluid 267 moves to dotted line 268, breaking the light path between bulb 269 and sensor 272. However, as the pressure in area 17 decreases, fluid 267 recedes down tube 256 until the light path is established. At this point in time, sensor 272 supplies an actuating signal to driver 261 to close relay contacts 250A. It is to be understood that sensor 272 has a suitable threshold for emitting an actuating pulse to clearly cause one incremental adjustment. After brush 12 has been adjusted, the pressure is restored to volume 17 thereby returning the fluid 267 to dotted line 268.

Instead of a monometer type of differential measurement, a thin flexible diaphragm (not shown) may be interposed between volumes 17 and 80 such that when the pressure is reduced, the diaphragm relaxes to close a set of contacts (not shown) for actuating incremental adjustment. In both apparatus, suitable resynchronizing circuits, well known to those of ordinary skill in the art, are electrically interposed between driver 261 and the solenoid 256 and as shown in FIG. 9.

In another alternative embodiment, not shown in the present application, brush 12 is urged against photoconductor surface 14 by a spring (not shown). The spring has a predetermined force. As the brush wears, it tends to move closer to the photoconductor surface 14 resulting in a slight displacement of the brush and a reduced force. Either the displacement of the reduced force can be sensed for actuating solenoid 256 as described with respect to FIG. 9. In yet another embodiment, a pressure sensor is installed in fluid communication with area 17. This sensor has an inverting amplifier which then drives an actuator, pushing brush 12 against photoconductor surface 14. As air pressure in volume 17 reduces, the inverting amplifier increases the drive to continuously adjust brush 12 against photoconductor surface 14.

In summary, in accordance with practicing the present invention, a cleaning brush 12 is either incrementally or continuously adjusted in accordance with the machine operating characteristics for maintaining effective air impelling and photoconductor cleaning. The seals at the axial ends of the brush and knock-off bar being movable with the brush simplify the construction for reducing manufacturing costs while providing effective air sealing.

In yet another alternative embodiment, an elapsed time meter indicates machine status for actuating cleaning station adjustment. Independent motors may be used for operating the machine and adjusting the cleaning station.

While the invention has been particularly shown and described with reference to preferred embodiments thereof, it will be understood by those skilled in the art that various changes in form and detail may be made therein without departing from the spirit and scope of the invention.

What is claimed is:

1. In a reproducing machine, a surface cleaner for a photoconductor member having a surface to be cleaned, including in combination:

a fiber cleaning brush adapted to remove particulate material from the surface;

means supporting said fiber brush and said member for relative movement along a given direction for cleaning said surface;

status means indicating a predetermined machine status;

adjustment means responsive to said indication and being in said support means to relatively move said member and said fiber cleaning brush toward each other transversely to said given direction for maintaining predetermined cleansing contact between said surface and said fiber cleaning brush to compensate for brush wear; and means remote from said surface being cleaned and in an operative cleansing relationship with said fiber brush for removing particulate material therefrom.

2. The subject matter set forth in claim 1 further including linkage means operatively interconnecting said adjustment means and said remote means to repeatedly move said remote means into said fiber cleaning brush a predetermined distance as a series of incremental adjustments.

3. The subject matter set forth in claim 2 wherein said adjustment means has means for relatively moving both said surface and said fiber cleaning brush said predetermined distance each said adjustment.

4. The subject matter set forth in claim 1 wherein said member and said fiber cleaning brush have axially elongated circularly cylindrical shapes;

said support means including independent means supporting each said member and said brush for rotation about parallel axes, respectively; and said remote means being axially elongated and said operative cleansing relationship being a predetermined fiber impacting relationship to said brush along its cleaning axial length.

5. The subject matter of claim 4 wherein said adjustment includes a carriage movable along a line parallel to a common radial line of both said surface and said fiber cleaning brush; and said remote means being disposed in said impacting relationship to said fiber cleaning brush on a diameter of said fiber cleaning brush extending transverse to said given radial line.

6. The subject matter set forth in claim 5 wherein said adjustment means includes:

means indicating an end of adjustment; and reset means for returning said carriage a maximum distance radially away from said surface to be cleaned.

7. The subject matter set forth in claim 4 wherein said status means includes in combination:

a counter;

rotation indicating means responsive to rotation of said photoconductor member for actuating said counter to indicate said rotations; and threshold means responsive to said counter reaching a predetermined count to indicate said predetermined machine status.

8. The subject matter set forth in claim 7 wherein said rotation indicating means includes a tachometer disk on said member, and said counter being responsive to said tachometer disk rotation to count the revolutions of said member.

9. The subject matter set forth in claim 7 including drive means synchronously and intermittently rotating said fiber brush and said member;

said counter having a set of rotatable count wheels interconnected to perform a counting function and responsive to said rotation indicating means to adjust the count by one; and said threshold means including a release member responsive to said mechanical wheels reaching a predetermined physical relationship for mechanically actuating said adjustment means.

10. The subject matter set forth in claim 4 including metering means for measuring machine status showing cleansing contact between said brush and said member, and said threshold means including means responsive to said metering means to indicate whether or not said cleansing contact is said predetermined cleansing contact and having means operative when the cleansing contact is other than said predetermined cleansing contact for actuating said adjusting means.

11. The subject matter set forth in claim 10 further including a chamber in fluid communication with an area adjacent said brush and drum cleansing contact and receiving air therefrom for generating a predetermined pressure in said chamber;

said threshold means including pressure responsive means in fluid communication with said chamber for indicating air pressure induced therein by said brush during said cleansing contact; and means in said threshold means to indicate below-normal air pressure and having means actuating said adjustment means for moving said brush and member closer together.

12. The subject matter set forth in claim 4 further including a substantially air sealed housing enclosing said brush and including an air chamber inlet adjacent said cleansing contact for receiving air and particles removed from said surface and entrained in such air by the relative movement of said brush and said member such that particles removed by cleansing said member are entrained in air flow induced by air pumping action of said brush movement; and said adjustment means operative to adjust said brush and said member for maintaining operation of said brush as an air pump.

13. The subject matter set forth in claim 12 wherein said status means includes sensing means indicating an operational activity of said member surface;

counting means responsive to said sensing means to indicate an accumulated count of said activity up to a given modulus not less than a predetermined number; and said threshold means being responsive to said counting means to actuate said adjustment means to adjust said brush and said member each time activity of said member has reached said predetermined number.

14. The subject matter set forth in claim 13 further including a pair of annular air seals at the axial opposite ends of said air brush and being in air-fitting relationship to said chamber for making said brush a more effective air pump; and said annular air seals being of such an extent as to maintain seal with radial movements of said brush during each said adjustment.

15. The subject matter set forth in claim 14 wherein each said air seal in said pair of air seals includes an annular shoulder respectively extending coaxially over axial end portions of said fiber brush and being interposed between said brush and said member; and fibers on said brush axially aligned with said annular shoulders tending to seal said station in that particles carried by said brush are inhibited from axial travel past said axial end portions.

16. The subject matter set forth in claim 15 wherein said adjustment means includes means synchronously and equally adjusting said brush with respect to said member and means simultaneously adjusting said knock-off bar with respect to said brush.

17. The subject matter set forth in claim 16 further including actuatable common drive means for said member and said brush;

said counter comprising a plurality of mechanical counting wheels;

intermediate drive means drivingly interposed between said counter and said common drive means for actuating said counter in accordance with actuation of said common drive means;

said adjustment means including movably mounted plate means respectively operatively connected to each axial end of said brush and mounted for parallel movement toward and away from said member; and said adjustment means having cam means operatively connected to said plate means, respectively, and release means actuated by said counter for actuating said adjustment means to move both said plate means toward said member.

18. The subject matter set forth in claim 17 wherein said sensing means comprises a tachometer disk on said member and said counting means being responsive to rotation of said tachometer disk to tally revolutions of said member.

19. The subject matter set forth in claim 1 further including in combination:

said photoconductor member being an axially elongated circular cylindrical shape drum surface rotatable about an axis coaxial with the drum cylindrical surface;

said fiber cleaning brush having an axially elongated circular cylindrical shaped surface disposed parallel to said photoconductor member and rotatable about an axis extending parallel to the axis of said photoconductor member;

a frame mounting said photoconductor member for rotation about said axis and having a pair of upstanding end blocks spaced apart along said axes such that said fiber cleaning brush is disposed intermediate said upstanding end blocks, said end blocks extending transversely to said axes and having a pair of openings aligned with said brush axis of rotation;

a pair of parallel brush supporting plates, respectively, movably mounted on said end blocks for coordinated movements toward and away from said photoconductor member;

bearing means in each said brush mounting plates mounting said brush for rotation;

a housing enclosing said brush except in an immediate adjacent relationship to said photoconductor member for providing an air enclosure and including an air outlet remote from said member-to-brush contact such that rotation of said fiber brush impels air from adjacent said photoconductor member toward said outlet;

an annular seal on each said brush mounting plates and extending coaxially to said fiber brush over respective axial end portions thereof; and said fiber brush having axial end fibers in air sealing contact with said annular seals, all of said fibers axially intermediate said annular seals extending radially outwardly of said annular seals for cleaning contact with said photoconductor member.

20. The subject matter set forth in claim 19 further including in combination:

said remote means being a rigid and elongated knock-off bar extending parallel to said axes and in a fiber impacting relationship to said fibers axially intermediate said annular seals; and mechanical linkage means operatively interconnecting said brush mounting plates and said knock-off bar for rotating said knock-off bar toward said brush as said brush mounting plates move toward said photoconductor drum member.

21. The subject matter set forth in claim 20 further including annular antifriction collars respectively disposed inside said annular sealing means and in rubbing contact with said axial end fibers.

22. The subject matter set forth in claim 20 further including in combination:

first and second springs interposed between said frame and said brush mounting plates, respectively, for yieldably urging said brush mounting plates radially away from said photoconductor member;

a pivotable shaft disposed parallel to said axes and being rotatably mounted on said end blocks;

a cam on each portion of said pivotable shaft having cam contour surfaces precisely circumferentially aligned, and said contour surfaces exhibiting a gradient for moving said brush mounting plates in accordance with an expected brush fiber wear characteristic, a cam follower on each of said brush mounting plates in cam following relationship to said cams, respectively;

crank means on said brush mounting plates mounting said cam follower means and operatively engaged to said knock-off bar for rotating same toward said fiber brush as said cams urge said brush mounting plates toward photoconductor drum member; and means for repeatedly and incrementally pivoting said shaft for adjustably moving said brush mounting plates toward said photoconductor drum member via said camming action.

23. The subject matter set forth in claim 22 further including in combination:

a drive motor mounted on said frame;

drive connecting means interconnecting said drive motor and said photoconductor member for rotating same;

intermediate drive means interconnecting said brush and said drive motor for synchronously rotating said fiber brush with said photoconductor member; and said status means for indicating predetermined machine states operatively coupled to one of said drive means for receiving power therefrom to actuate said adjustment means to pivotably increment said pivotable shaft synchronously with said photoconductor member rotation.

24. The subject matter set forth in claim 23 further including scavanging means in said housing and interposed between said fiber brush and said housing outlet;

said scavanging means including a rotatable scavanging roll extending parallel to said axes;

additional drive means operatively interconnecting said drive motor and said scavanging roll for rotating same; and cam means on one end portion of said scavanging roll and being operatively engaged with said adjustment means for positively driving said adjustment means to pivotably increment said pivotable shaft.

25. The subject matter set forth in claim 24 further including a counter;

means responsive to said driving means operation to increment said counter;

intermediate cam follower means adjacent said counter and including escapement means holding said cam follower away from said scavanger roll driving cam;

said indicating means responsive to said counter reaching a predetermined state to release said escapement means for allowing said cam follower to move toward said driving means for driving engagement therewith and means in said adjustment means operatively interconnecting said cam follower to said pivotable shaft for pivotably incrementing same as driven by said driving cam.

26. The subject matter set forth in claim 19 further including in combination:

said brush mounting plates being movably mounted on said upstanding end blocks along a surface facing away from said brush, respectively;

each said end block said openings being substantially coaxial with said brush axis of rotation and having a predetermined radius for allowing radial movement of said brush with respect to said end blocks;

a pair of support means respectively on said brush mounting plates and coaxial with said brush axis of rotation extending through said openings in said end blocks, respectively;

an air seal extending around said openings on each side of both said end blocks and being in air sealing sliding contact with said end blocks and being affixed to said brush mounting plates for sealing said openings against air movement; and an annular antifriction collar disposed inside said first-mentioned air seal and being in rubbing engagement with said short fibers of said brush.

27. The subject matter set forth in claim 26 further including a pair of cup-shaped air seals disposed on opposite ends of said knock-off bar and being in sliding engagement, respectively, with said end blocks; and spring means interposed between said cup members and each end of said knock-off bar.

28. The subject matter set forth in claim 27 further including in combination:

said knock-off bar being disposed on a radius of said brush transverse to a radius intersecting the point of contact between said brush and said photoconductor member; and a resilient air seal extending inside said housing to an air sealing engagement with a free end of said knock-off bar and extending between said cup-shaped air seals such that as said knock-off bar rotates toward said fiber brush said resilient air seal maintains air sealing relationship with said knock-off bar such that air impelled by said brush travels from said point of contact with said photoconductor drum member toward said scavanging means inside said housing.

29. The subject matter set forth in claim 1 wherein said fiber cleaning brush has a circularly cylindrical shape, means for mounting said brush for rotation about an axis coaxial with said circular cylindrical shape;

said photoconductor member having a circular cylindrical shape and rotatable about an axis parallel to said brush rotatable rotation axis and coaxial with the circular cylindrical surface of said photoconductor member;

the improvement further including in combination:

a single drive means for simultaneously rotating said brush and said photoconductor member in opposite directions of rotations;

said brush being disposed over said photoconductor member;

a housing having an inlet opening extending parallel to said axes of rotation and extending about said circular cylindrical surface of said brush in spaced-apart relation and having an opening extending the axial length of a cleaning portion of said brush, said opening being disposed over said photoconductor member;

a rotatable electrically charged scavanging roll in said housing interposed between said outlet and said brush and mounted for rotation about an axis parallel to said brush axis;

drive means interconnecting said single drive means to said scavanger roll for rotating same synchronously with said photoconductor member and said brush;

said remote means being disposed between said scavanging roll and brush inside said housing and further including air sealing means extending from said housing to said remote means for directing air impelled by said brush past said scavanging roll;

a cam mounted on said scavanging roll and rotatable therewith; and cam follower means in said adjustment means responsive to said indication to engage said scavanger roll cam for driving said brush toward said photoconductor member such that adjustment of said brush toward said photoconductor member is synchronous to a predetermined portion of rotation of said photoconductor member as manifested by the mounting of the cam on said scavanging roll.

30. The subject matter set forth in claim 29 wherein said remote means comprises a knock-off bar pivotably supported within said housing and said air sealing means comprising a resilient flap extending from said housing wall to engagement with said knock-off bar between said scavanging roll and said knock-off bar; and mechanical linkage means in said adjustment means operatively connected to and supporting said knock-off bar for adjusting same into said brush as said brush is adjusted into said photoconductor member.

31. The subject matter set forth in claim 30 wherein said indicating means comprises air pressure sensing means having fluid communication within said housing on both sides of said air sealing means and responsive to air pressure differential reduction to indicate said predetermined machine status.

32. The subject matter set forth in claim 30 wherein said indicating means comprises means operatively connected to said single driving means and means indicating a predetermined number of machine driving cycles for indicating said predetermined machine status.

33. The subject matter set forth in claim 30 wherein said indicating means includes means measuring predetermined machine activity and means indicating said predetermined machine status upon a predetermined tally being reached; and feed-forward control means in said adjustment means to relatively move said member and said fiber cleaning brush toward each other in accordance with a predetermined feed-forward control function independent of actual brush-member relationship.

34. The subject matter set forth in claim 30 wherein said status means includes means measuring the effectiveness of a given machine operation including operation of said brush;

means in said status means responsive to said measurement reaching a predetermined condition to indicate said predetermined machine status whereby adjustment of said member and said fiber cleaning brush is based upon measurement of said brush operational effectiveness for providing feedback control of said adjustment.

35. For use in a duplicating machine having a cyclically movable image transfer member to be cleaned between successive images to be duplicated, a cleaning member, drive means for moving said image transfer member in a series of motions;

the improvement including in combination:

support means adjustably mounting said cleaning member in cleaning contact with said image transfer member such that said members can be repeatedly adjusted toward each other;

an adjustment actuator operatively connected to said drive means for adjusting said members synchronously with said image transfer member motions;

a housing at least partially enclosing said cleaning member such that an inlet to the housing is adjacent contact of said cleaning member with said image transfer member, said housing including a cavity for enclosing said cleaning member and a second cavity portion for enclosing a scavenging chamber;

a scavenging member in said scavenging chamber;

a filter in said housing providing fluid communication between said scavenging chamber and outside said housing;

said drive means rotating said scavenging member synchronously with said image transfer member motions;

cam drive means on said scavenging member and in camming relationship to said adjustment actuator for actuating same in synchronism with said image transfer member motions;

means preventing actuation of said adjustment actuator; and means indicating a given machine status and operative to override said preventing means for allowing said cam drive means to actuate said adjustment actuator.

36. The subject matter set forth in claim 35 wherein said indicating means in operatively connected to said drive means;

means in said indicating means for tallying a number representative of the number of motions of said image transfer member;

threshold means operatively associated with said tallying means for indicating that a predetermined number has been counted; and means responsive to said predetermined number indication to override said prevention means.

37. The subject matter set forth in claim 36 further including in combination:

means in said tallying means for detecting that said drive means has repeatedly moved said image transfer member to a second portion of any image transfer member motion and said tallying means being further responsive to said given portion indication to actuate said counter; and said one portion occurring in each transfer member motion after said given portion whenever said motion is used for an image transfer.

38. The subject matter set forth in claim 35 wherein said tallying means includes mechanical linkage responsive to said drive means repeatedly moving said image transfer member to a given portion of a given motion;

an actuating pawl on said linkage means movable into a predetermined count indicating position during said given portion of said image transfer member motion;

said counter comprising a series of coaxial ratchet wheels, one of which is in operative relationship to said pawl in such a manner that said pawl actuates said one ratchet wheel one tooth position each time said given portion is traversed by said image transfer member;

said counter having count indicating means; and mechanical sensing means responsive to said count indicating means reaching a predetermined position to actuate said adjustment actuator.

39. For use in a duplicating machine, an improved cleaning station for cleaning an adjacent photoconductor member;

a drive motor, drive connection means drivingly connecting said motor and said member for effecting a series of member motions;

means operatively connected to said drive connection means for effecting predetermined machine operations synchronously with said member motions;

the improvement including in combination:

a cleaning member in cleaning contact with said photoconductor member;

support means adjustably mounting said cleaning member to move same with respect to said photoconductor member for adjusting said cleaning contact;

indicating means operatively connected to said drive connection means for indicating a given number of predetermined machine operations;

means responsive to said indication to actuate said support means to move said cleaning member toward said drum;

said indicating means including mechanical counter means for preserving a tally of said number of predetermined machine operations, said tally having a predetermined relationship to the number of motions in a series of motions of said member;

sensing means in said indicating means sensing that said given number of predetermined machine operations has occurred for indicating same; and said responsive means operatively connected to said drive connection means for moving said cleaning member toward said photoconductor member during a predetermined portion of a given one of said member motions, said given one member motion having a predetermined relationship to said member motions yielding said given number of predetermined machine operations.

40. For use in a duplicating machine, an improved cleaning station for cleaning an adjacent photoconductor drum;

drive motor, drive connection means drivingly connecting said motor and said drum for effecting a series of drum rotations;

means operatively connected to said drive connection means for effecting predetermined machine operations synchronously with said drum rotations;

the improvement including in combination:

a cleaning member in cleaning contact with said photoconductor drum;

support means adjustably mounting said cleaning member to move same with respect to said photoconductor drum for adjusting said cleaning contact;

indicating means operatively connected to said drive connection means for indicating a given number of predetermined machine operations;

means responsive to said indication to actuate said support means to move said cleaning member toward said drum;

means drivingly interengaging said input shaft to said drive connection means for rotating same a predetermined number of times for a given number of said drum rotations;

mechanical linkage means responsive to a given rotation of said input drive shaft for moving to a predetermined position;

tally means responsive to said linkage means being in said predetermined position to advance the count by unity; and sensing means responsive to said counting means indicating a predetermined count to supply said indication of said given number of predetermined machine operations.

41. For use in a duplicating machine, an improved cleaning station for cleaning an adjacent photoconductor drum;

a drive motor, drive connection means drivingly connecting said motor and said drum for effecting a series of drum rotations;

means operatively connected to said drive connection means for effecting predetermined machine operations synchronously with said drum rotations;

the improvement including in combination:

a cleaning member in cleaning contact with said photoconductor drum;

support means adjustably mounting said cleaning member to move same with respect to said photoconductor drum for adjusting said cleaning contact;

indicating means operatively connected to said drive connection means for indicating a given number of predetermined machine operations;

means responsive to said indication to actuate said support means to move said cleaning member toward said drum;

a tachometer disk mounted for rotation with said drum;

sensing means in operative relationship to said tachometer disk for sensing rotations and rotational positions of said photoconductor drum;

logic means responsive to said tachometer disk indications to actuate said indicating means;

said indicating means including tallying means responsive to said actuation for tallying said rotations of said drum; and output means in said indicating means supplying said given indication whenever said tally reaches a predetermined count.

42. For use in a duplicating machine, an improved cleaning station for cleaning an adjacent photoconductor drum;

a drive motor, drive connection means drivingly connecting said motor and said drum for effecting a series of drum rotations;

means operatively connected to said drive connection means for effecting predetermined machine operations synchronously with said drum rotations;

the improvement including in combination:

a cleaning member in cleaning contact with said photoconductor drum;

support means adjustably mounting said cleaning member to move same with respect to said photoconductor drum for adjusting said cleaning contact;

indicating means operatively connected to said drive connection means for indicating a given number of predetermined machine operations;

means responsive to said indication to actuate said support means to move said cleaning member toward said drum;

said indicating means including the following:

a mechanical counter;

means interposed between said mechanical counter and said drive connection means for actuating same for each cycle of operation of said drive connection means;

said cycle of said drive connection means corresponding to one drum rotation;

adjustment actuating means connected to said drive connection means; and release means interposed between said indicating means and said adjustment drive means for inhibiting interaction of said adjustment drive means and said responsive means and further including release means responsive to said indication of a given number of predetermined machine operations for releasing same such that said adjustment driving means drives said responsive means for actuating said support means to move the cleaning member.

43. For use in a duplicating machine, an improved cleaning station for cleaning an adjacent photoconductor drum;

a drive motor, drive connection means drivingly connecting said motor and said drum for effecting a series of drum rotations;

means operatively connected to said drive connection means for effecting predetermined machine operations synchronously with said drum rotations;

the improvement including in combination:

a fiber brush cleaning member in cleaning contact with said photoconductor drum;

support means adjustably mounting said cleaning member to move same with respect to said photoconductor drum for adjusting said cleaning contact;

indicating means operatively connected to said drive connection means for indicating a given number of predetermined machine operations;

means responsive to said indication to actuate said support means to move said cleaning member toward said drum;

a knock-off bar disposed in contact with said cleaning member remote from said photoconductor drum;

bar supporting means supporting said knock-off bar for movement with and into cleaning member including three axial end support means; and means connecting said responsive means to said bar supporting means for effecting simultaneous bar and member adjustments.

44. For use in a duplicating machine having an image transfer member cyclically movable pasts a plurality of operating stations for processing successive images to be duplicated;

drive means for repeatedly moving said image transfer member in a series of successive image transfer cycles, one of said operating stations having a rotatable brush member adapted to contact said image transfer member during movements of said image transfer member;

the improvement including in combination:

support means relatively adjustably mounting said rotatable brush member in operative contact with said image transfer member such that said members are repeatedly adjusted toward each other; and an adjustment actuator operatively connected to said drive means for synchronously adjusting said members during a predetermined portion of given ones of said image transfer member movements.

45. The subject matter set forth in claim 44 further including:

means for tallying a number representative of the number of successive movements of said image transfer member;

threshold means operatively associated with said tallying means for indicating that a predetermined number has been counted; and means responsive to said predetermined number indication to enable said adjustment actuator to adjust said rotatable brush member.

46. The subject matter set forth in claim 45 further including in combination:

means in said tallying means for detecting that said drive means has moved said image transfer member to a predetermined portion of a given one image transfer member movement and said tallying means being further responsive to said predetermined portion indication to actuate said tallying means; and said predetermined portion occurring in each member movement whenever said image transfer member is used for an image transfer.

47. For use in a duplicating machine having a cyclically movable image transfer member for transferring successive images to be duplicated between an input optical apparatus and copy paper, drive means for cyclically moving said image transfer member in a series of image transferring motions, an operating station member adjacent said image transfer member and requiring a predetermined spatial relationship therewith to perform a predetermined function in said image transfer member, the improvement including in combination:

support means relatively adjustably mounting said operating station member in predetermined spatial relation with said image transfer member such that said members can be repeatedly adjusted toward each other; and an adjustment actuator operatively connected to said members for synchronously adjusting same toward said predetermined spatial relation with respect to said image transferring motion.

48. A document production machine having a repeatedly movable image transfer member for transferring successive images from an image input station to copy paper, drive means for repeatedly moving said image transfer member past a plurality of stations including said image input station, one of said stations including an operating member requiring a predetermined spatial relationship with respect to said image transfer member, the improvement including in combination:

means relatively adjustably mounting said members; and means responsive to a predetermined machine condition relating to said image transfer member for actuating said adjustably mounting means to adjust said members toward said predetermined spatial relation.

* * * * *